US008740757B1

(12) United States Patent
FioRito et al.

(10) Patent No.: US 8,740,757 B1
(45) Date of Patent: Jun. 3, 2014

(54) EXERCISE ATTACHMENT FOR A SHOE AND METHOD OF USE

(76) Inventors: Daniel P. FioRito, Addison, IL (US); Mark Charles Rosal, Wood Dale, IL (US)

( * ) Notice: Subject to any disclaimer, the term of this patent is extended or adjusted under 35 U.S.C. 154(b) by 184 days.

(21) Appl. No.: 13/134,595

(22) Filed: Jun. 10, 2011

(51) Int. Cl.
*A63B 21/00* (2006.01)

(52) U.S. Cl.
USPC ..... 482/79; 482/80; 36/72; 36/74

(58) Field of Classification Search
USPC ..... 482/79, 80; 36/7.2, 7.4, 72, 74
See application file for complete search history.

(56) References Cited

U.S. PATENT DOCUMENTS 2,206,902 A * 7/1940 Kost ..... 601/27
5,339,542 A * 8/1994 Kim ..... 36/7.2
6,311,416 B1 * 11/2001 Cohen ..... 36/136
7,500,324 B1 * 3/2009 Power et al. ..... 36/132

OTHER PUBLICATIONS

Website http://www.jumpusa.com/mm5/merchant.mvc?screen=1001Prods (See Attached 3 Pages) Shows an Attachment for a Shoe Which Has a Rounded Member Under the Back of the Attachment.

* cited by examiner

*Primary Examiner* — Jerome W Donnelly
(74) *Attorney, Agent, or Firm* — Ted Masters

(57) ABSTRACT

An exercise attachment for a shoe includes a platform upon which the shoe rests. A shoe strap is removably connectable to the platform, and is used to hold the shoe in place on the platform. The platform has a rounded pivot member disposed on its bottom surface. The rounded pivot member contacts a support surface, and allows the exercise attachment to pitch, roll, and yaw about the rounded pivot member. The shoe strap is connected to the platform by an anchor member which has an elongated pocket which selectively receives a locking rod.

5 Claims, 12 Drawing Sheets

EXERCISE ATTACHMENT FOR A SHOE AND METHOD OF USE

CROSS REFERENCE TO RELATED APPLICATION

None

TECHNICAL FIELD

The present invention pertains generally to lower extremity exercise, and more particularly to an exercise attachment which is connected to the shoe of a user.

BACKGROUND OF INVENTION

Exercise devices which attach to the shoes of a user are known in the art. These devices can be utilized to strengthen the muscles of the foot and lower leg, to shape and tone the calves and thighs, and to improve balance. Some of these devices employ the principal of plyometrics with a view toward improving sports performance. In pylometrics muscles are loaded and then contracted in rapid sequence. A rapid muscle lengthening movement (eccentric phase) is followed by an explosive muscle shortening movement (concentric phase). Some of these devices also improve proprioception, which is one's sense of the relative position of neighboring parts of the body.

Randomization plays an important role in training. The human body has evolved to adapt to different stresses so that it can quickly recover and survive. During a workout muscles are torn down with the purpose of building them back up. However, the body will adapt to an exercise routine and it becomes very difficult to achieve gain by tearing the same muscles down with the same exercises. As such, a training plateau is reached. However, by using a randomized training process, the muscles continually undergo different and random stresses and the training plateau is raised. To this end, balance balls were introduced with great acceptance for applying randomization to core & upper body exercises. There are different balance boards and wobble boards that do a similar, but less effective job than the balance ball. The problem is that most people can't stand on a balance ball while doing their exercise.

BRIEF SUMMARY OF THE INVENTION

The present invention is directed to an exercise attachment which connects to the shoe of a user. The invention employs the pylometric, proprioception, and randomization concepts in exercising the lower extremities and core of the body. Exercise attachments are strapped to the shoes (typically a gym shoe) of the user for a period of time (e.g. 15 minutes per day). The user then proceeds with their normal activities while wearing the exercise attachments. A rounded pivot member is disposed on the bottom of the exercise attachment, and the user must use the muscles of the ankle, feet, calves, thighs, gluts, and core to maintain balance. As such these muscles are strengthened and toned. The exercise attachment is designed so that non-athletes as well as athletes can use the attachment for balance, foot, ankle, leg, glut, and core strengthening.

In accordance with an embodiment, the exercise attachment includes a platform which has a top side, and an opposite bottom side. A rounded pivot member is disposed on the bottom side of the platform. A shoe strap is removably connectable to the platform, the shoe strap for retaining the shoe on the platform.

In accordance with another embodiment, the platform has a first side and an opposite second side. A first slot is disposed in the first side and has a first width. The first slot extends from the top side to the bottom side. A second slot is disposed in the second side and has a second width. The second slot extends from the top side to the bottom side. The shoe strap has a first anchor member which is shaped and dimensioned to pass though the first slot, the first anchor member having a first elongated pocket. The shoe strap also has a second anchor member which is shaped and dimensioned to pass though the second slot, the second anchor member having a second elongated pocket. A first locking rod is shaped and dimensioned to be received by the first elongated pocket, and when so received the first elongated pocket has a first pocket width which is greater than the first width of the first slot. A second locking rod is shaped and dimensioned to be received by the second elongated pocket, and when so received the second elongated pocket has a second pocket width which is greater than the second width of the second slot. When the first anchor member is passed through the first slot from the top side of the platform to the bottom side of the platform, and the first locking rod is inserted into the first elongated pocket, the first elongated pocket is prevented from passing back through the first slot from the bottom side of the platform to the top side of the platform. And, when the second anchor member is passed through the second slot from the top side of the platform to the bottom side of the platform, and the second locking rod is inserted into the second elongated pocket, the second elongated pocket is prevented from passing back through the second slot from the bottom side of the platform to the top side of the platform.

In accordance with another embodiment, the rounded pivot member has a width of about 3.375 inches.

In accordance with another embodiment, the platform includes a rim which upwardly projects from the top side, and has an inside wall, an outside wall, and a front most portion. The rounded pivot member has a center which is disposed between about 5.0 inches and about 5.5 inches from the inside wall of the front most portion of the rim.

In accordance with another embodiment, the shoe is a size 6, size 7, or size 8 women's shoe having a shank. The rounded member has a center. When the shoe is connected to the platform, the center of the pivot member resides directly below the shank of the shoe.

In accordance with another embodiment, the platform has a forward pitch angle of less than 20°.

In accordance with another embodiment, the platform has a roll angle of less than 20°.

Other possible embodiments, in addition to the possible embodiments enumerated above, will become apparent from the following detailed description, taken in conjunction with the accompanying drawings, which illustrate, by way of example, the principles of the exercise attachment and method of use.

DETAILED DESCRIPTION OF THE INVENTION

Figure 27:
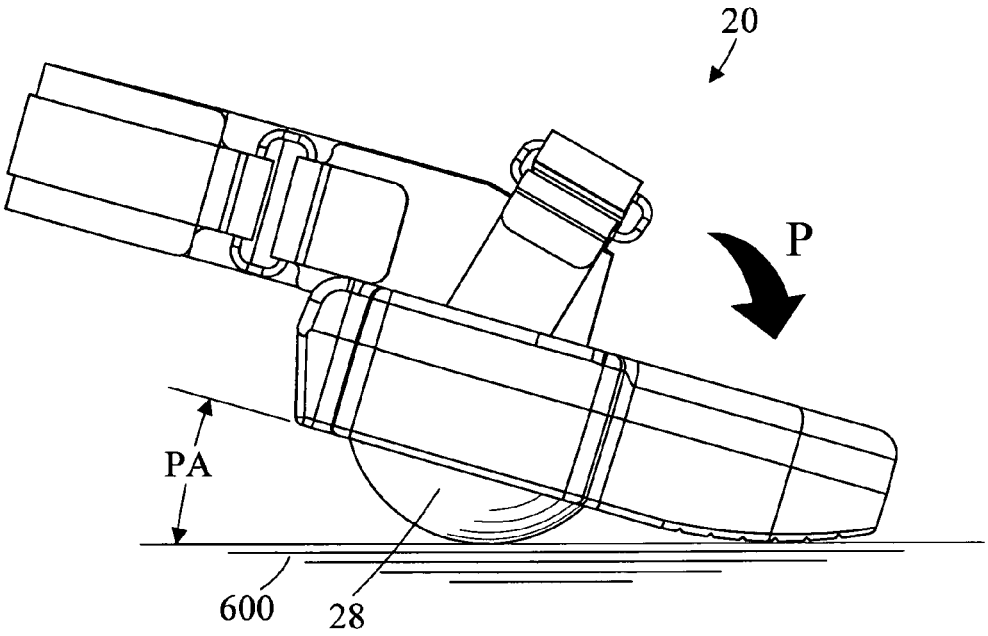
FIG. 27 is a side elevation view of the exercise attachment in a pitched forward position; and, FIG. 28 is a front elevation view of the exercise attachment in a rolled position.
Figure 28:
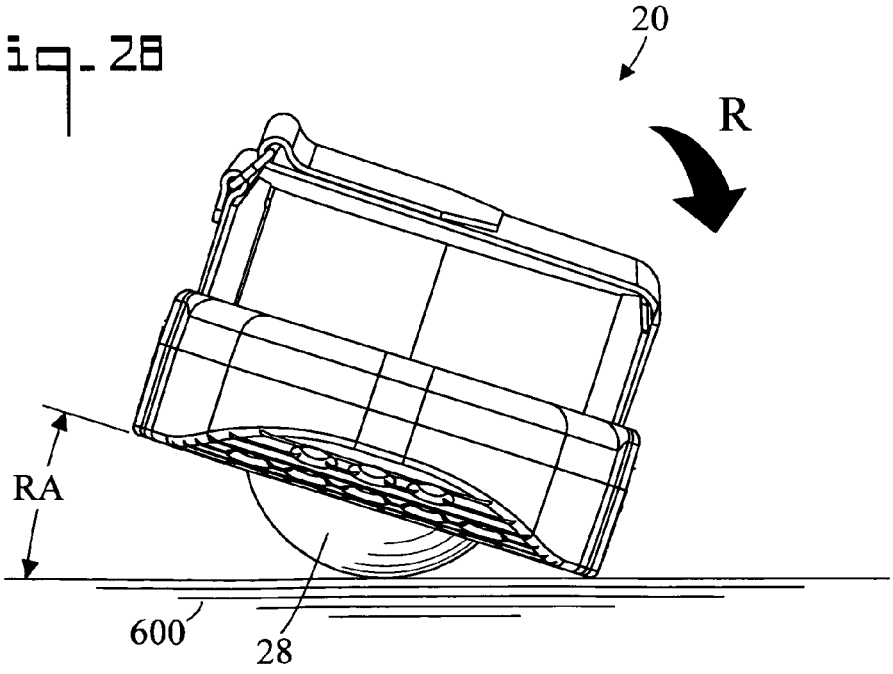

Referring initially to FIGS. 1-8, there are illustrated top perspective, exploded top perspective, bottom perspective, top plan, side elevation, opposite side elevation, front elevation, and rear elevation views respectively of an exercise attachment for a shoe, generally designated as 20. Exercise attachment 20 includes a platform 22 which has a top side 24, and an opposite bottom side 26 (also refer to FIGS. 11-17). A rounded pivot member 28 is disposed on bottom side 26 of platform 22. Also referring to FIGS. 27 and 28, when exercise attachment 20 is placed on a support surface 600 (such as a floor), it is free to pivot (tilt or rock) with respect to support surface 600 about rounded pivot member 28. That is, exercise attachment 20 can pitch forward as is shown in FIG. 27 or pitch back, or roll to the left as is shown in FIG. 28 or roll to the right, or any combination of pitch and roll. Exercise attachment 20 can also yaw clockwise or counterclockwise as is shown by the arrows in FIG. 4. The terms pitch, roll, and yaw are the same as used in the aviation industry to describe rotary motion about a transverse axis, a longitudinal axis, and an upwardly projecting axis respectively. It is through this tilting action of platform 22 that the muscles of a wearing user are exercised. Platform 22 also includes a U-shaped rim 30 which upwardly projects from top side 24 of platform 22. Rim 30 holds shoe 500 in place on platform 22, wherein the toe of shoe 500 abuts the front most portion of rim 30 (also refer to FIGS. 25 and 26). In an embodiment, platform 22 weighs about 3 pounds.

A shoe strap 32 is removably connectable to platform 22. Shoe strap 32 is used to retain shoe 500 on platform 22 (refer to FIGS. 25 and 26). As used herein the term "removably connectable" means that shoe strap 32 is not fixedly connected to platform 22, but is rather designed to be easily connected to platform 22 and disconnected from platform 22 by a user without the use of tools or damage to either shoe strap 32 or platform 22. This separated design reduces manufacturing costs and allows shoe strap 32 to be replaced should it become damaged. In the shown embodiment, shoe strap 32 is fashioned from a flexible material such as a fabric.

The removable connection of shoe strap 32 to platform 22 is effected by a slot, pocket, and locking rod design. Platform 22 has first side and an opposite second side. A first slot 34 is disposed in the first side, first slot 34 having a first width SW1, and first slot 34 extends from top side 24 to bottom side 26 of platform 22 (also refer to FIGS. 11-17). A second slot 36 is disposed in the second side, second slot 36 having a second width SW2, and second slot 36 extends from top side 24 to bottom side 26 of platform 22 (also refer to FIGS. 11-17). Shoe strap 32 has a first anchor member 40 which is shaped and dimensioned to pass though first slot 34. First anchor member 40 has a first elongated pocket 42 at its distal end (also refer to FIGS. 9-10 and 18-24). Shoe strap 32 has a second anchor member 44 which is shaped and dimensioned to pass though second slot 36. Second anchor member 44 has a second elongated pocket 46 at its distal end (also refer to FIGS. 18-24). Elongated pockets 42 and 46 are tube-shaped.

A first locking rod 48 (pin) (refer to FIGS. 2, 3, 8, and 9) is shaped and dimensioned to be closely received by first elongated pocket 42, and when so received first elongated pocket 42 has a first pocket width PW1 (refer to FIG. 9) which is greater than first width SW1 of first slot 34. A second locking rod 50 (refer to FIGS. 3 and 8) is shaped and dimensioned to be closely received by second elongated pocket 46, and when so received second elongated pocket 46 has a second pocket width PW2 which is greater than second width SW2 of second slot 36.

Figure 9:
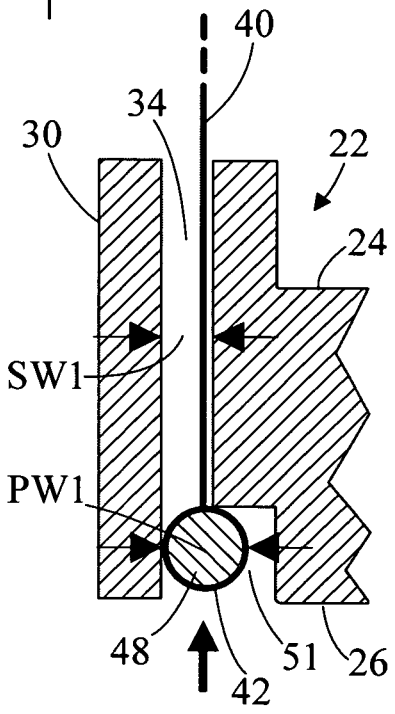
FIG. 9 is an enlarged fragmented cross sectional view along the line 9-9 of FIG. 4.
Figure 10:
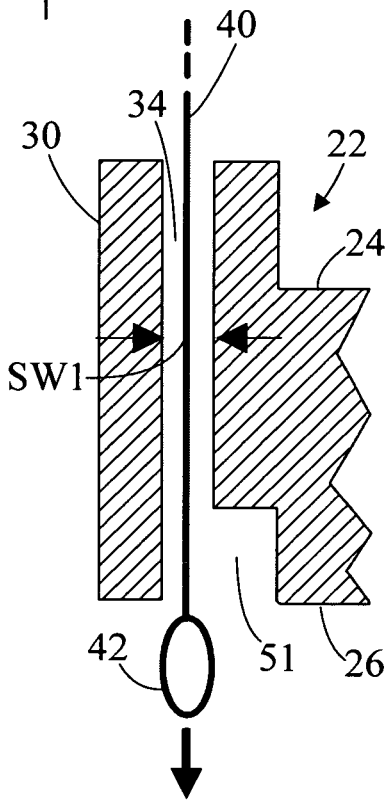
FIG. 10. is another enlarged fragmented cross sectional view as in FIG. 9.

Also referring to FIGS. 9 and 10, first anchor member 40 is passed through first slot 34 from top side 24 of platform 22 to bottom side 26 of platform 22. First locking rod 48 is then inserted into first elongated pocket 42, thereby preventing first elongated pocket 42 (and first locking rod 48) from passing back through first slot 34 from bottom side 26 of platform 22 to top side 24 of platform 22. This is because first pocket width PW1 of first pocket 42 with first locking rod 48 installed, is greater than the first width SW1 of first slot 34. Similarly, when second anchor member 44 is passed through second slot 36 from top side 24 of platform 22 to bottom side 26 of platform 22, and second locking rod 50 is inserted into second elongated pocket 46, second elongated pocket 46 (and second locking rod 50) is prevented from passing back through second slot 36 from bottom side 26 of platform 22 to top side 24 of platform 24.

Figure 1:
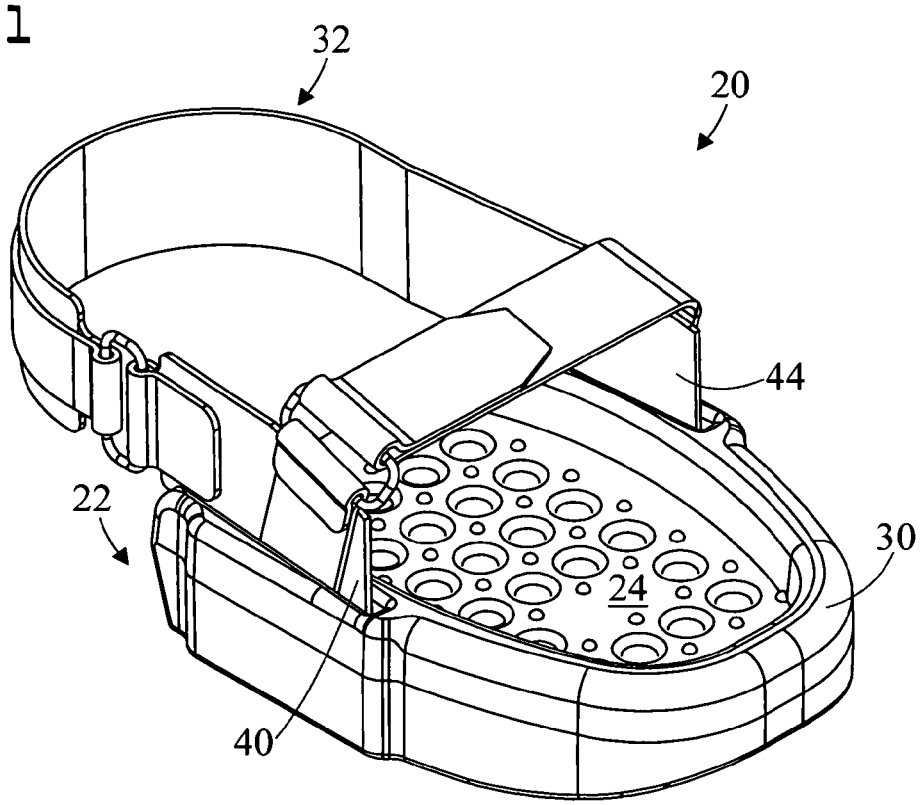
FIG. 1 is a top perspective view of an exercise attachment for a shoe.
Figure 2:
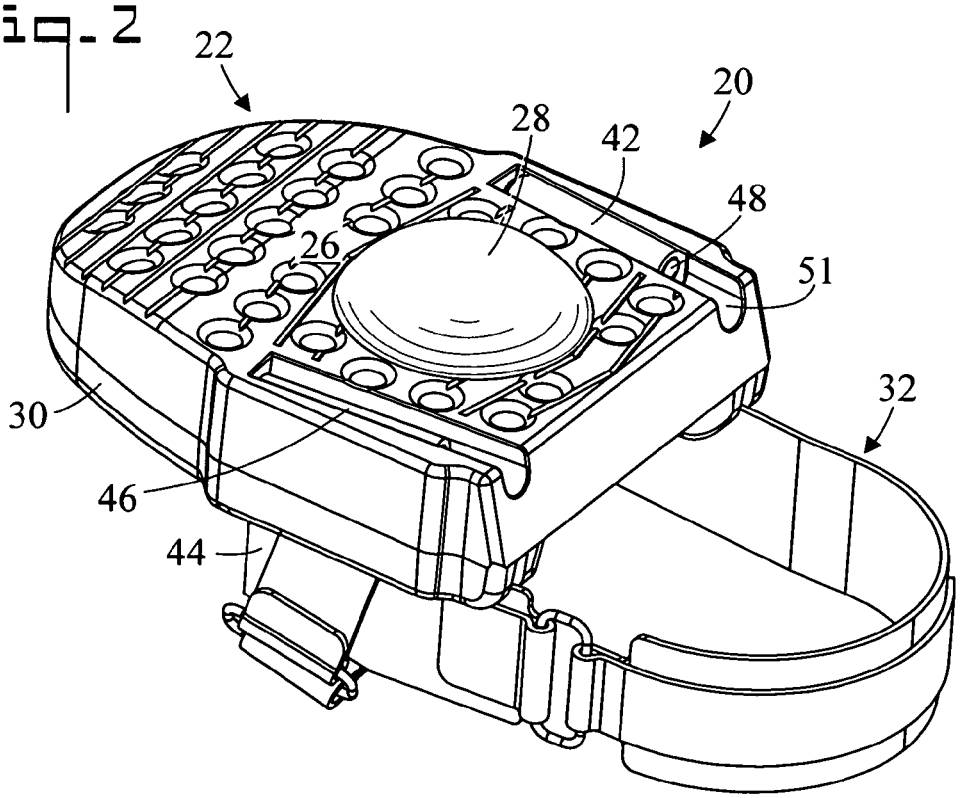
FIG. 2 is an exploded top perspective view of the exercise attachment.
Figure 3:
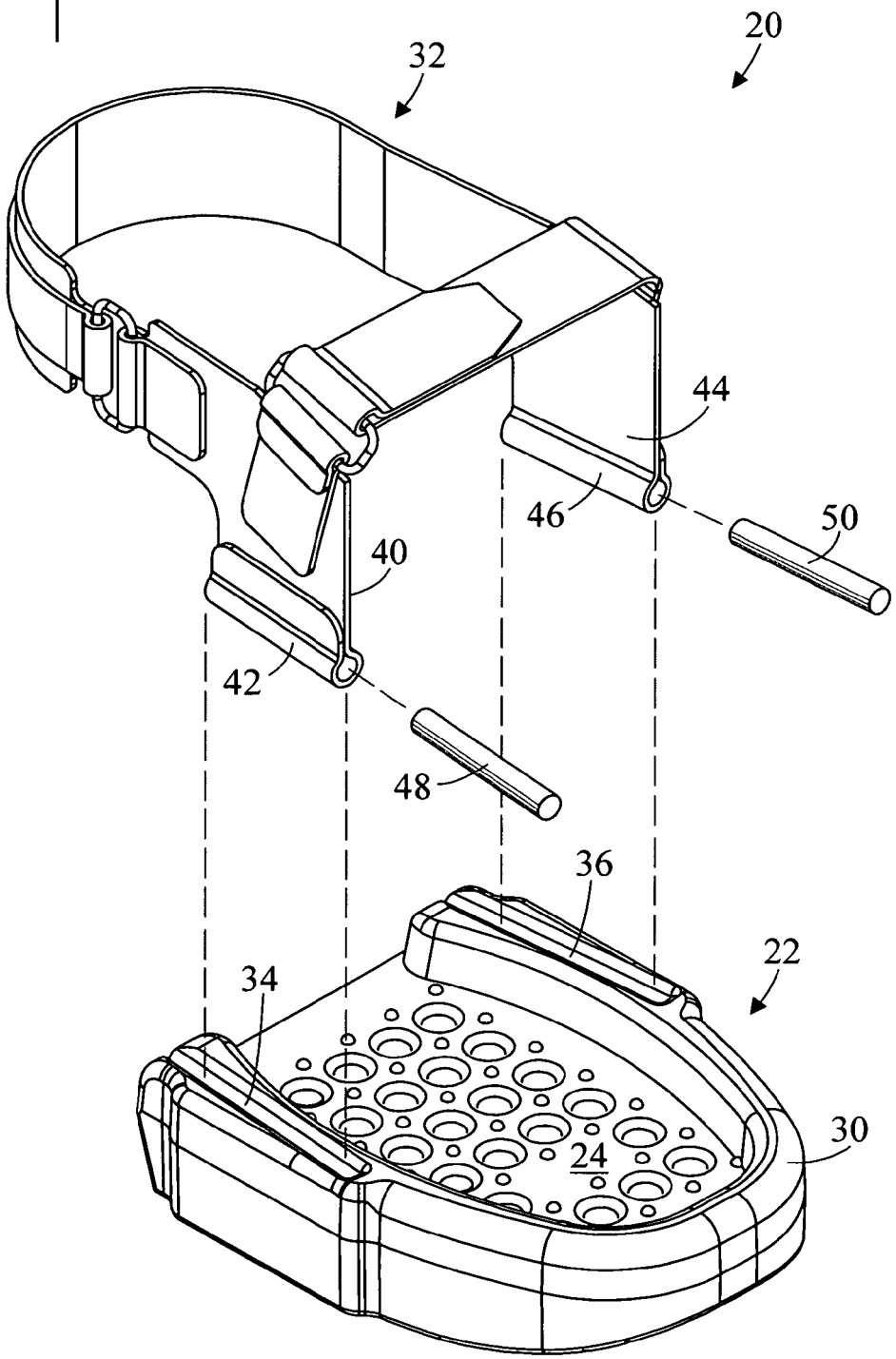
FIG. 3 is a bottom perspective view of the exercise attachment.
Figure 4:
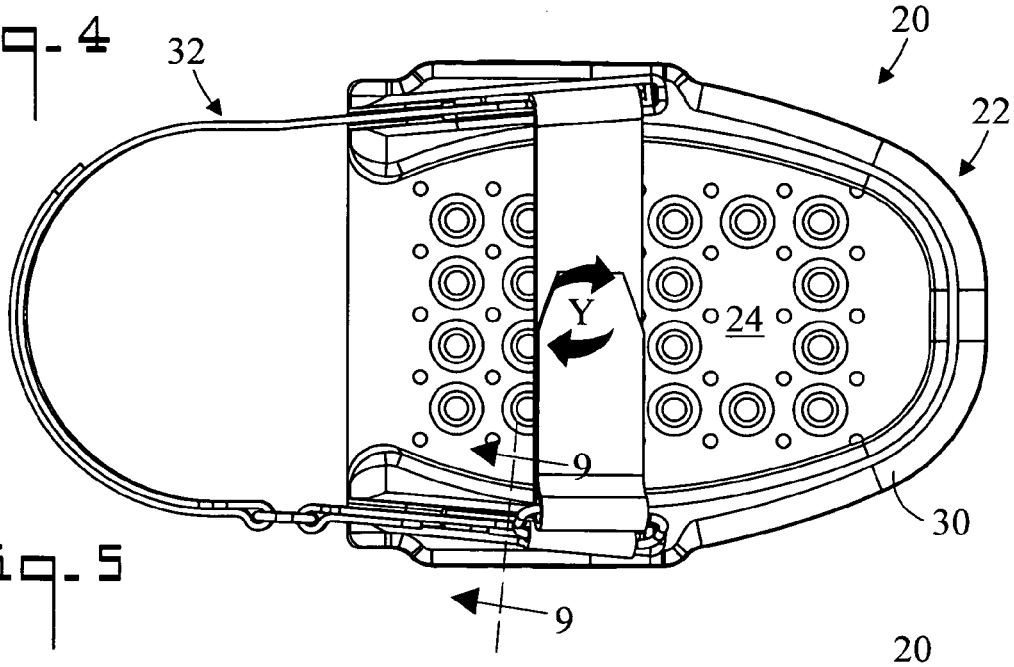
FIG. 4 is a top plan view of the exercise attachment.
Figure 5:
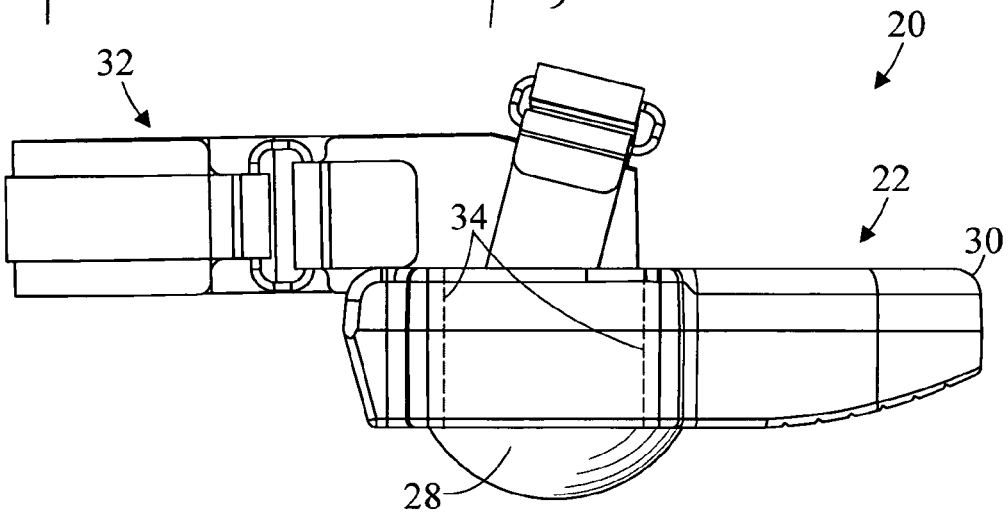
FIG. 5 is a side elevation view of the exercise attachment.
Figure 6:
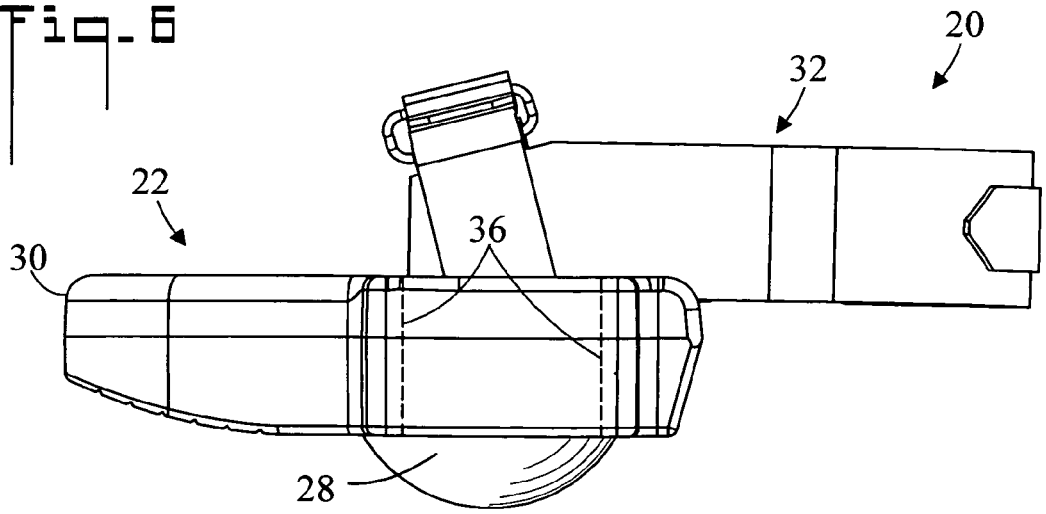
FIG. 6 is an opposite side elevation view of the exercise attachment.
Figure 7:
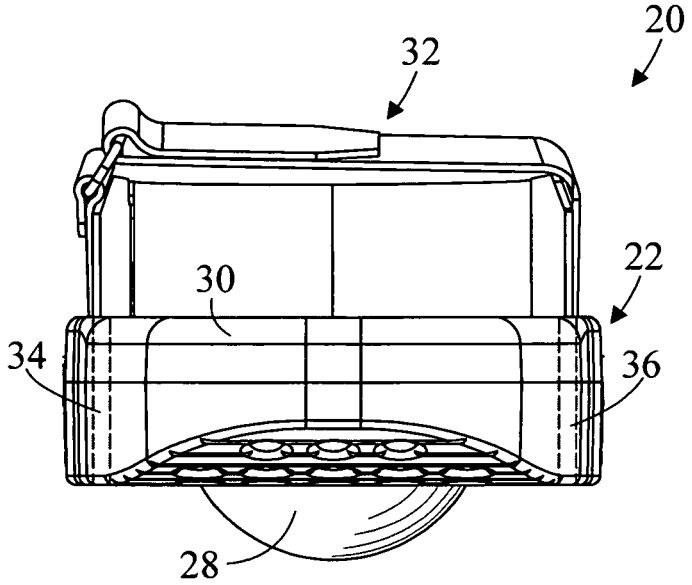
FIG. 7 is a front elevation view of the exercise attachment.
Figure 8:
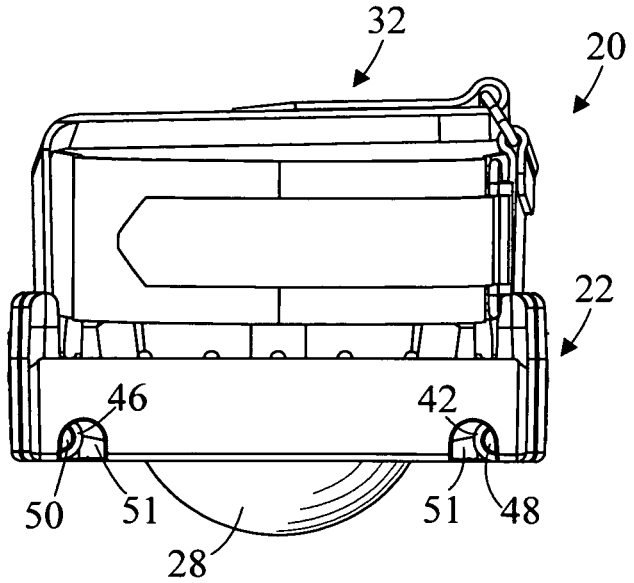
FIG. 8 is a rear elevation view of the exercise attachment.

FIG. 9 is an enlarged fragmented cross sectional view along the line 9-9 of FIG. 4, and FIG. 10. is another enlarged fragmented cross sectional view as in FIG. 9. These two figures show the interaction of first slot 34, first anchor member 40, first elongated pocket 42, and first locking rod 48. It may be appreciated however that the same description applies to the interaction of second slot 36, second anchor member 44, second elongated pocket 46, and second rod 50. First referring to FIG. 10, first anchor member 40 with first elongated pocket 42 is passed from top side 24 to bottom side 26 of platform 22. The passage of first elongated pocket 42 through first slot 34 is made possible by the fact that the pocket is flexible and can compress to fit into first slot 34. Then in FIG. 9, first locking rod 48 has been inserted into first elongated pocket 42, giving the pocket and locking rod combination a width of PW1 which is greater than the width SW1 of slot 34. As such, first elongated pocket 42 with first locking rod 50 prevents first anchor member 40 from moving upward, thereby locking first anchor member 40 and shoe strap 32 in place in platform 22. When first anchor member is pulled upward, first elongated pocket 42 with first locking rod 48 enters a cavity 51 on the bottom side 26 of platform 22, but because if its width is blocked and cannot pass upward through first slot 34. First anchor member 40 can only be freed to move upward by first removing first locking rod 48. It is noted that in the shown embodiment, first locking rod 48 is circular and first pocket width PW1 is the diameter of first locking rod 48 and the surrounding first elongated pocket 42. In an embodiment, first slot width SW1 is about 0.188 inches, and the width (diameter) of locking rod 48 is about 0.375 inches.

FIGS. 11-17 are top plan, side elevation, bottom plan, front elevation, rear elevation, rear perspective, and bottom perspective views respectively of platform 22. Shown are top side 24, bottom side 26, rounded pivot member 28, rim 30, first slot 34, second slot 36, first slot width SW1, and second slot width SW2. Top side 24 of platform 22 includes a plurality of friction enhancing nubs 52 which serve to grip shoe 500 (refer to FIGS. 25 and 26). Top side 24 and bottom side 26 of platform also include a plurality of holes 54 which reduce the weight of platform 22. In an embodiment, platform 22 is made from a composite material covered with a friction enhancing material such as rubber.

Figure 12:
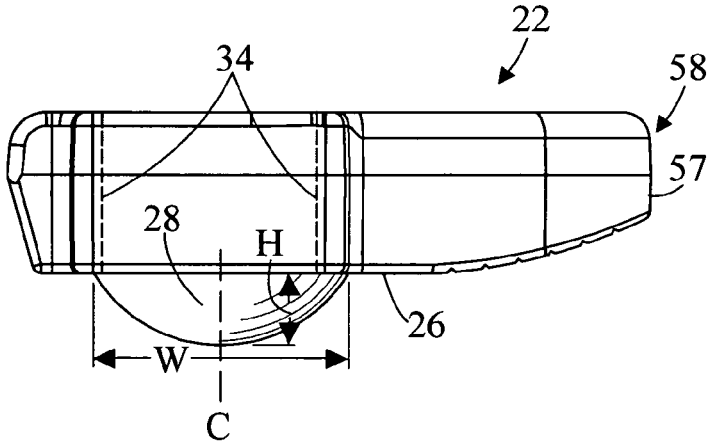
FIG. 12 is a side elevation view of the platform.
Figure 13:
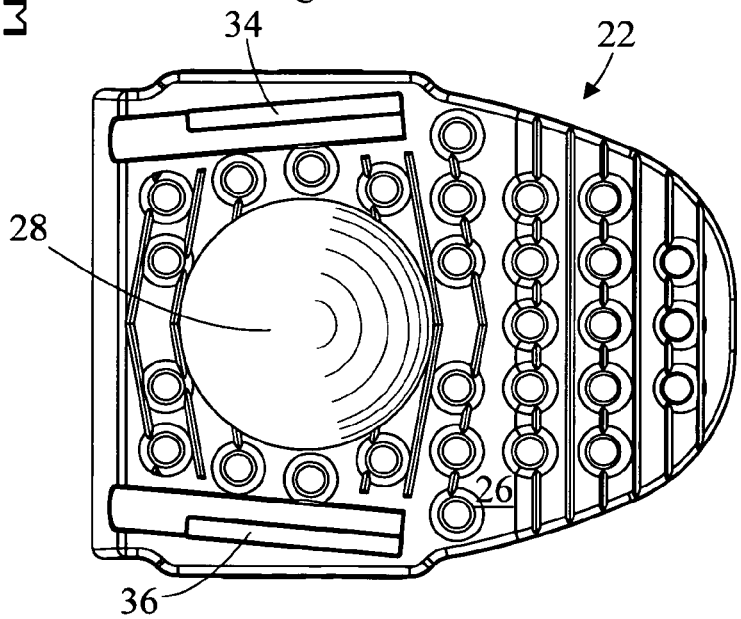
FIG. 13 is a bottom plan view of the platform.
Figure 14:
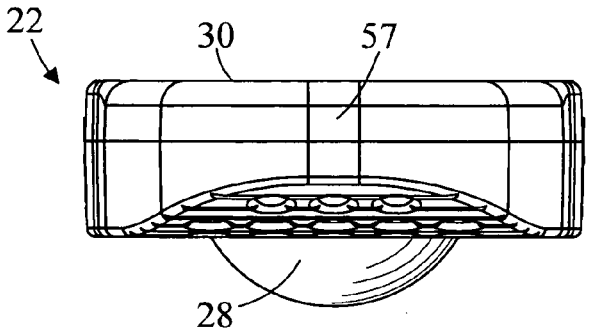
FIG. 14 is a front elevation view of the platform.
Figure 15:
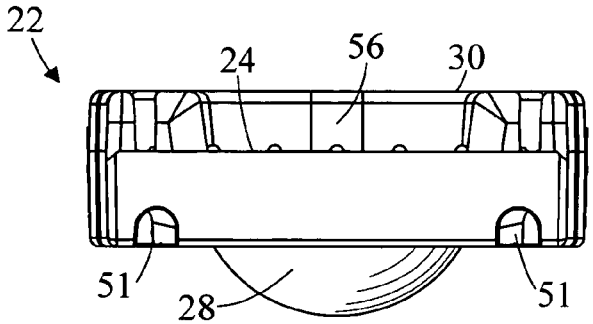
FIG. 15 is a rear elevation view of the platform.
Figure 16:
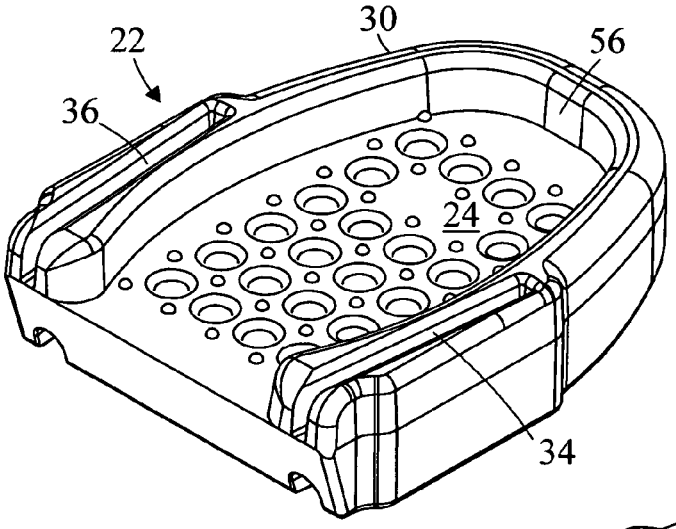
FIG. 16 is a rear perspective view of the platform.
Figure 17:
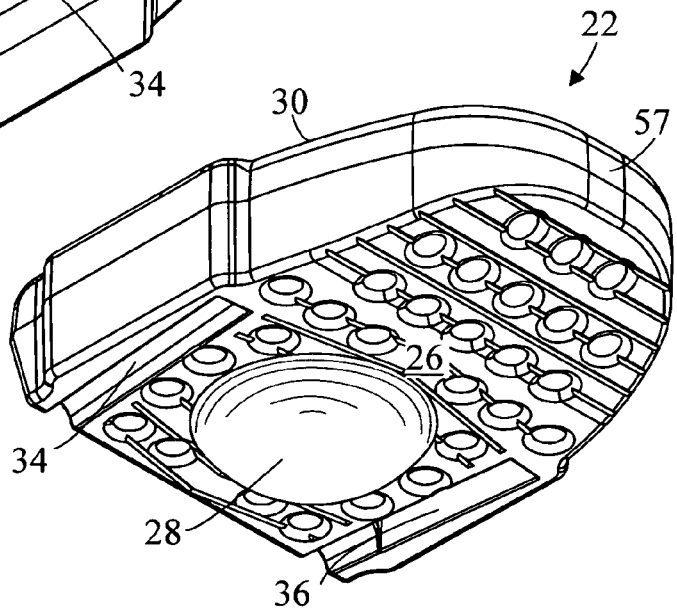
FIG. 17 is a bottom perspective view of the platform.
Figure 18:
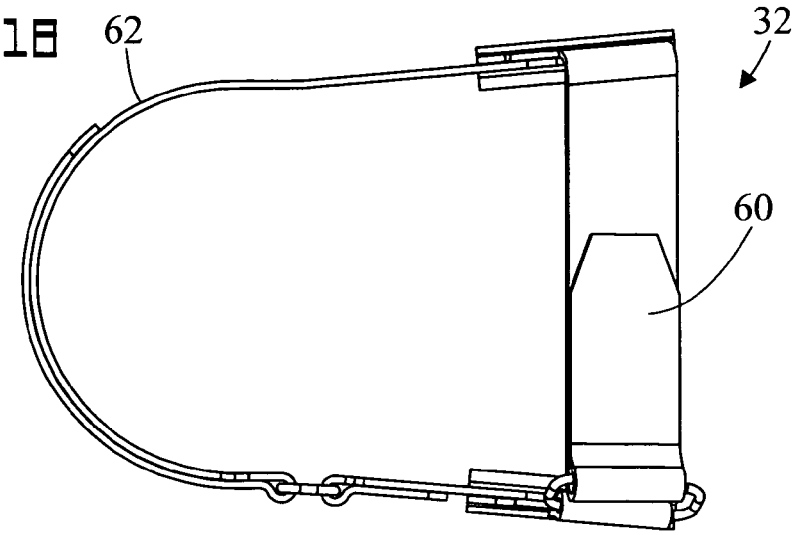
FIG. 18 is a top plan view of a shoe strap.
Figure 19:
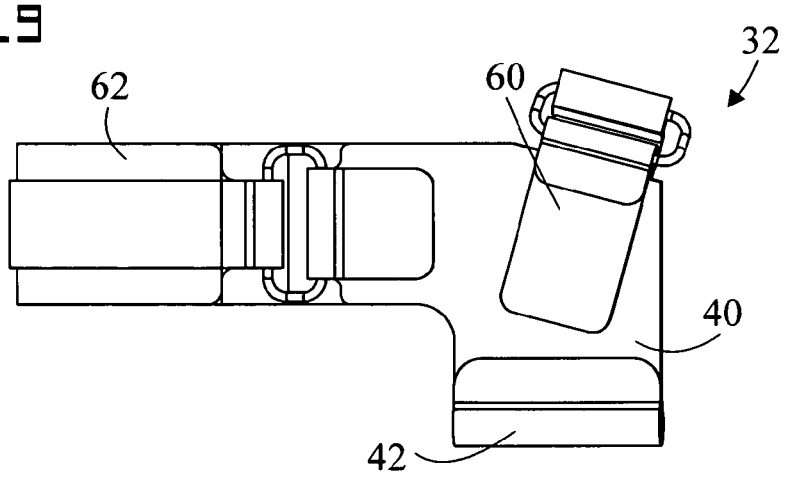
FIG. 19 is a side elevation view of the shoe strap.
Figure 20:
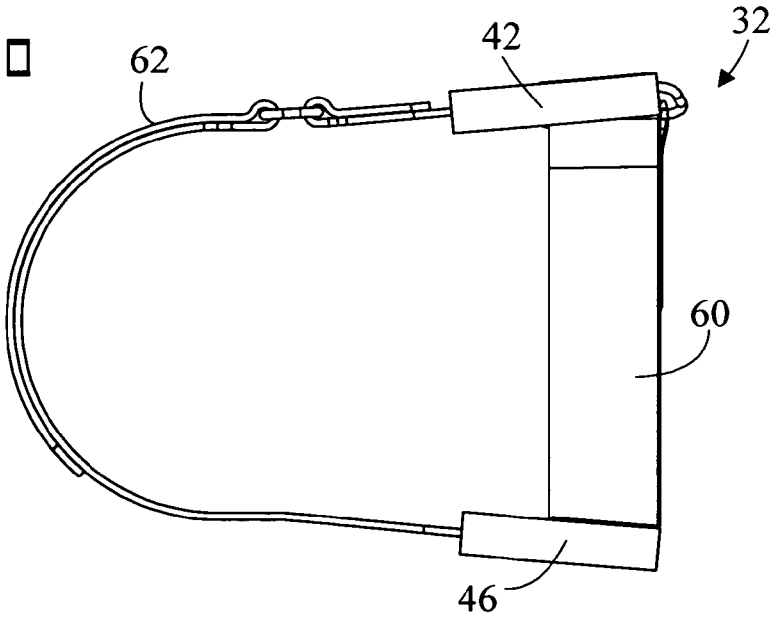
FIG. 20 is a bottom plan view of the shoe strap.
Figure 21:
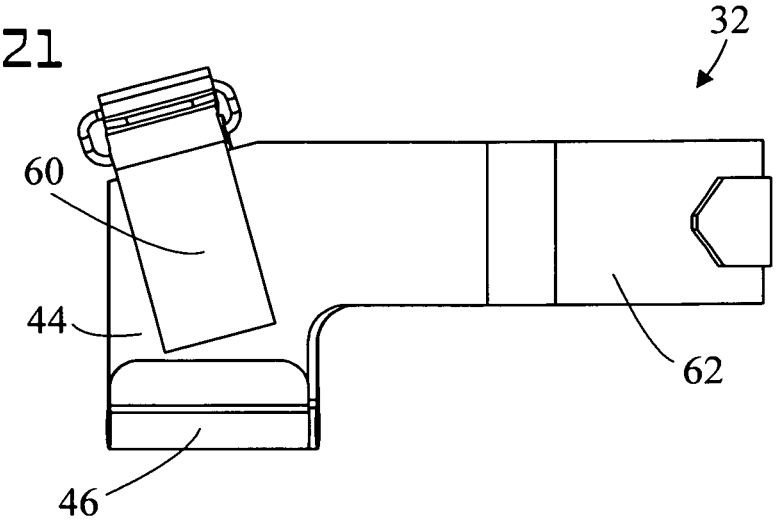
FIG. 21 is an opposite side elevation view of the shoe strap.
Figure 22:
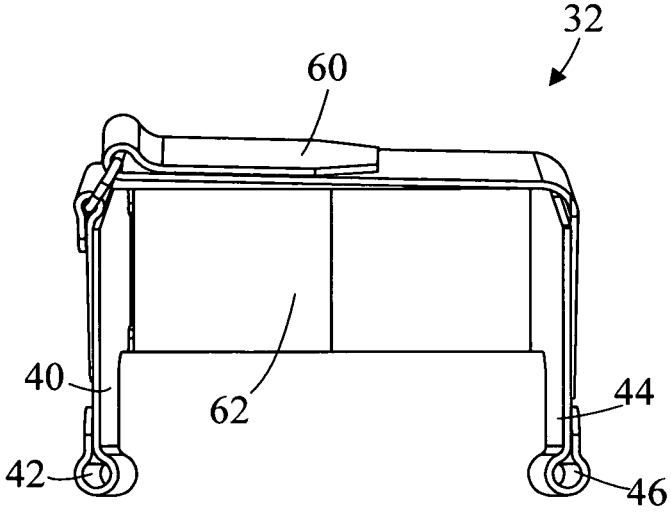
FIG. 22 is a front elevation view of the shoe strap.
Figure 23:
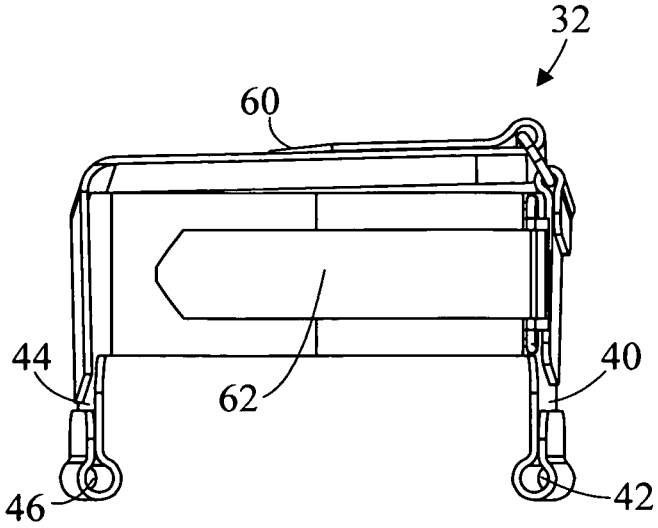
FIG. 23 is a rear elevation view of the shoe strap.
Figure 24:
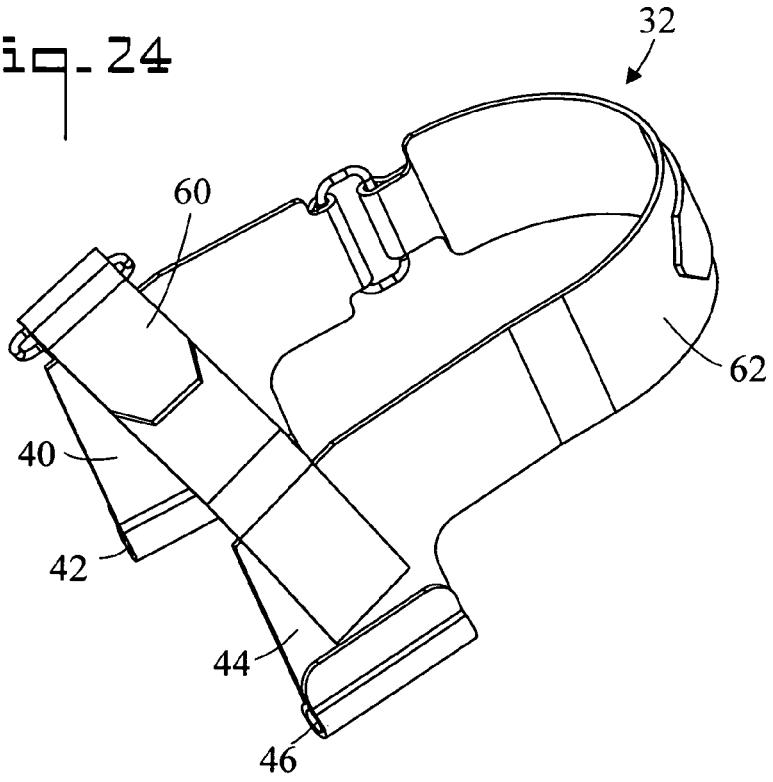
FIG. 24 is a perspective view of the shoe strap.

Referring to FIG. 12, rounded pivot member 28 has a height H (from bottom side 26) of about one inch, and a width W of about 3.375 inches. And, rounded pivot member 28 is a truncated sphere (a portion of a sphere truncated by a plane). The rounded pivot member 28 is large enough to provide a sufficient surface area which limits the controlled imbalance so that normal activities can be performed without difficulty.

Figure 11:
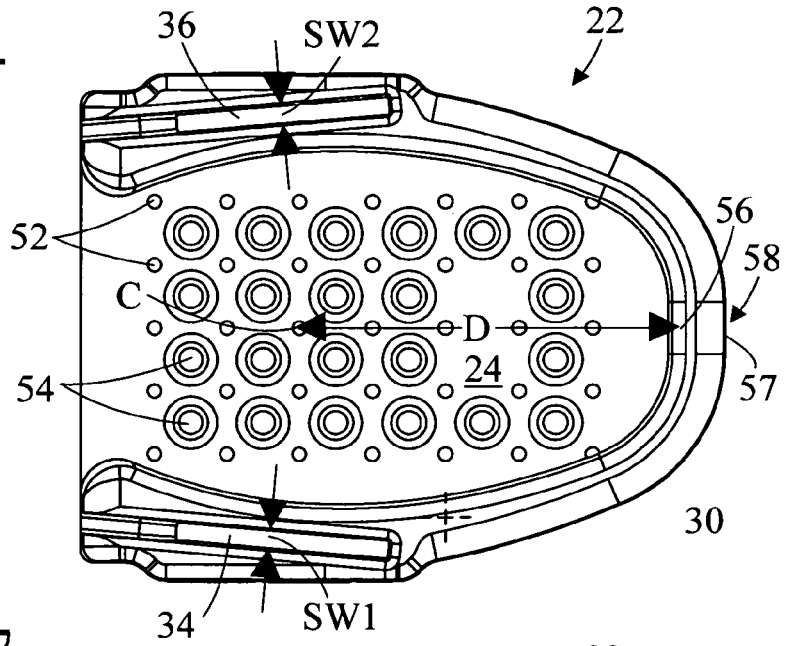
FIG. 11 is a top plan view of a platform.

Referring to FIGS. 11 and 12, upwardly projecting rim 30 has an inside wall 56 and an outside wall 57 (also refer to FIGS. 16 and 17), and a front most portion (toe) 58. Rounded pivot member 28 has a center C. Center of rounded pivot member 28 is disposed a distance D which is between about 5.0 inches and about 5.5 inches from inside wall 56 of front most portion 58 of rim 30. This positioning places rounded pivot member 28 directly beneath the shank (center portion) of shoe 500, and therefore at the arch of a women's size 6-8 shoe.

FIGS. 18-24 depict top plan, side elevation, bottom plan, opposite side elevation, front elevation, rear elevation, and perspective views respectively of shoe strap 32. Shown are first anchor member 40, second anchor member 44, first elongated pocket 42, and second elongated pocket 46. Shoe strap 32 further includes a vamp adjustment strap 60 and a heel adjustment strap 62 for connecting shoe strap 32 to shoe 500 (also refer to FIGS. 25 and 26). In the shown embodiment, adjustment straps 60 and 62 employ buckles and hook and loop fasteners to connect shoe 500 to platform 22.

Figure 25:
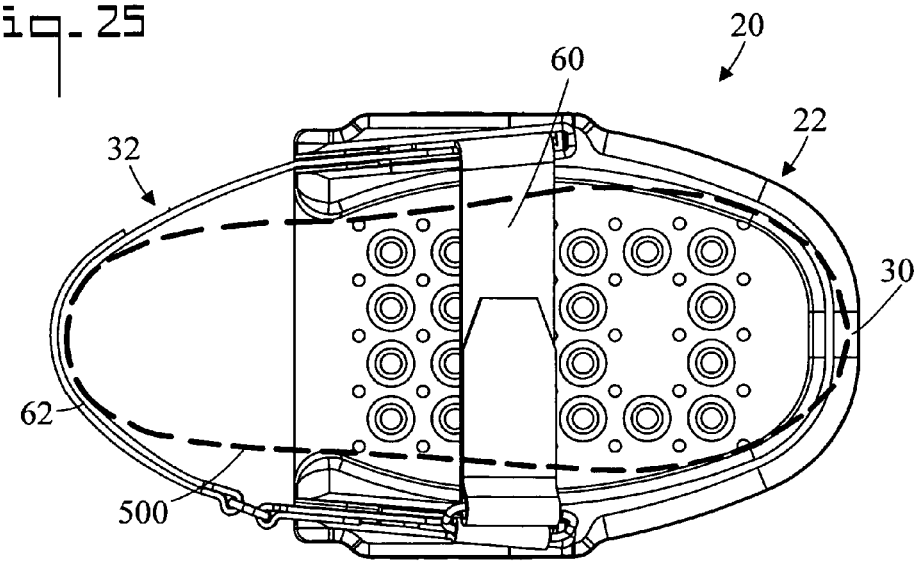
FIG. 25 is a top plan view of the exercise attachment connected to a shoe.
Figure 26:
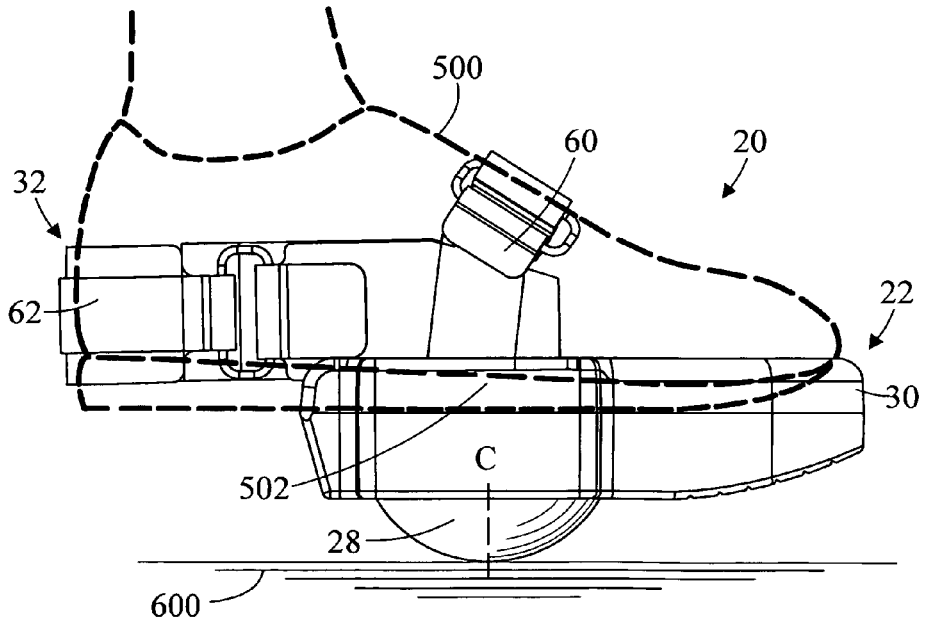
FIG. 26 is a side elevation view of the exercise attachment connected to the shoe.

FIGS. 25 and 26 are top plan and side elevation views respectively of exercise attachment 20 connected to shoe 500. Shoe 500 is placed on platform 22 with the toe of shoe 500 abutting the front of rim 30. In the shown embodiment, shoe 500 is a women's size 6-8 shoe which has a shank 502 (the center portion between the sole/outsole and the heel) which corresponds with the arch of the user's foot. When exercise attachment 20 is in the horizontal position as in FIG. 26, center C of rounded pivot member 28 resides directly below shank 502 of shoe 500. This places the tilting point of rounded pivot member substantially below the arch of the user, as opposed to near the ball of the foot as in prior art devices. It is noted that platform 22 is long enough so that only the heel of shoe 500 hangs off the rear end of the platform, thereby reducing strain on the Achilles tendon. While women's size 6-8 shoes are a target embodiment, shoes sizes of up to men's 15 can be used with exercise attachment 20.

The centered placement of rounded pivot member 28 establishes the best center of balance for users to build their balance system. Positioning rounded pivot member 28 beneath the ball of the foot can throws off the user's natural stance and can have negative effects on posture. The constant randomization of muscles firing throughout the feet, calves, thighs, gluts, and core muscles while the body attempts to maintain its balance on exercise attachment 20 causes the neurons to fire over a thousand times per second, and the proprioceptors (balance muscles) to activate. This whole randomization process while wearing the present invention guarantees that no two workouts will be the same. As such, users don't hit plateaus in their training where muscles get accustomed to certain movements and build up resistance to training. This results in faster muscle toning and quicker results in strengthening said muscle groups in the body.

FIG. 27 is a side elevation view of exercise attachment 20 in a pitched forward position. In this position platform 22 tilts forward until its forward portion abuts support surface 600. In an embodiment, platform 22 has a forward pitch angle PA of less than 20°. A greater pitch angle PA causes more than desired stress and strain on the muscles of the foot and leg.

FIG. 28 is a front elevation view of exercise attachment 20 in a rolled position. In this position platform 22 tilts to the left (or right) until its side portion abuts support surface 600. In an embodiment platform 22 has a roll angle RA of less than 20°. As with pitch angle PA, a greater roll angle RA causes more than desired stress and strain on the muscles of the foot and leg In terms of use, a method for attaching an exercise attachment 20 to a shoe 500 of a user includes: (refer to FIGS. 1-28)

(a) providing a shoe 500;

(b) providing an exercise attachment 20 for shoe 500 including;

- a platform 22 having a top side 24, and an opposite bottom side 26;
- a rounded pivot member 28 disposed on bottom side 25 of platform 22;
- a shoe strap 32 which is removably connectable to platform 22, shoe strap 32 for retaining shoe 500 on platform 22;
- platform 22 having a first side and an opposite second side;
- a first slot 34 disposed in the first side, first slot 34 having a first width SW1, first slot 34 extending from top side 24 to bottom side 26;
- a second slot 36 disposed in the second side, second slot 36 having a second width SW2, second slot 36 extending from top side 24 to bottom side 26;
- shoe strap 32 having a first anchor member 40 which is shaped and dimensioned to pass though first slot 34, first anchor member 40 having a first elongated pocket 42;
- shoe strap 32 having a second anchor member 44 which is shaped and dimensioned to pass though second slot 36, second anchor member 44 having a second elongated pocket 46;
- a first locking rod 48 which is shaped and dimensioned to be received by first elongated pocket 42, and when so received first elongated pocket 42 having a first pocket width PW1 which is greater than first width SW1 of first slot 34;
- a second locking rod 50 which is shaped and dimensioned to be received by second elongated pocket 46, and when so received second elongated pocket 46 having a second pocket width PW2 which is greater than second width SW2 of second slot 36;

(c) passing first anchor member 40 through first slot 34 from top side 24 of platform 22 to bottom side 26 of platform 22;

(d) inserting first locking rod 48 into first elongated pocket 42, thereby preventing first elongated pocket 42 from passing back through first slot 34;

(e) passing second anchor member 44 through second slot 36 from top side 24 of platform 22 to bottom side 26 of platform 22; and, (f) inserting second locking rod 50 into second elongated pocket 46, thereby preventing second elongated pocket 46 from passing back through second slot 36. It is noted that step (d) must be performed after step (c), and step (f) must be performed after step (e).

The method further including:

using shoe strap 32 to connect shoe 500 to platform 22.

The method further including:

disconnecting shoe strap 32 from shoe 500;

removing first locking rod 48 from first elongated pocket 42;

passing first anchor member 40 through first slot 34 from bottom side 26 of platform 22 to top side 24 of platform 22;

removing second locking rod 50 from second elongated pocket 46; and, passing second anchor member 44 through second slot 36 from bottom side 26 of platform 22 to top side 24 of platform 22.

The possible embodiments of the exercise attachment and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the exercise attachment and method should be construed as limiting the invention to a particular embodiment or combination of embodiments. The scope of the invention is best defined by the appended claims.

We claim:

1. An exercise attachment for a shoe, comprising:

a platform having a top side, and an opposite bottom side;

a rounded pivot member disposed on said bottom side of said platform;

a shoe strap which is removably connectable to said platform, said shoe strap for retaining the shoe on said platform;

said platform having a first side and an opposite second side;

a first slot disposed in said first side, said first slot having a first width, said first slot extending from said top side to said bottom side;

a second slot disposed in said second side, said second slot having a second width, said second slot extending from said top side to said bottom side;

said shoe strap having a first anchor member which is shaped and dimensioned to pass though said first slot, said first anchor member having a first elongated pocket;

said shoe strap having a second anchor member which is shaped and dimensioned to pass though said second slot, said second anchor member having a second elongated pocket;

a first locking rod which is shaped and dimensioned to be received by said first elongated pocket, and when so received said first elongated pocket having a first pocket width which is greater than said first width of said first slot;

a second locking rod which is shaped and dimensioned to be received by said second elongated pocket, and when so received said second elongated pocket having a second pocket width which is greater than said second width of said second slot;

so that when said first anchor member is passed through said first slot from said top side of said platform to said bottom side of said platform, and said first locking rod is inserted into said first elongated pocket, said first elongated pocket is prevented from passing back through said first slot from said bottom side of said platform to said top side of said platform; and, so that when said second anchor member is passed through said second slot from said top side of said platform to said bottom side of said platform, and said second locking rod is inserted into said second elongated pocket, said second elongated pocket is prevented from passing back through said second slot from said bottom side of said platform to said top side of said platform.

2. An exercise attachment for a shoe, comprising:

a platform having a top side, and an opposite bottom side;

a rounded pivot member disposed on said bottom side of said platform;

a shoe strap which is removably connectable to said platform, said shoe strap for retaining the shoe on said platform;

said platform having a first side and an opposite second side;

a first slot disposed in said first side, said first slot having a first width, said first slot extending from said top side to said bottom side;

a second slot disposed in said second side, said second slot having a second width, said second slot extending from said top side to said bottom side;

said shoe strap having a first anchor member which is shaped and dimensioned to pass though said first slot, said first anchor member having a first elongated pocket;

said shoe strap having a second anchor member which is shaped and dimensioned to pass though said second slot, said second anchor member having a second elongated pocket;

a first locking rod which is shaped and dimensioned to be received by said first elongated pocket, and when so received said first elongated pocket having a first pocket width which is greater than said first width of said first slot;

a second locking rod which is shaped and dimensioned to be received by said second elongated pocket, and when so received said second elongated pocket having a second pocket width which is greater than said second width of said second slot;

so that when said first anchor member is passed through said first slot from said top side of said platform to said bottom side of said platform, and said first locking rod is inserted into said first elongated pocket, said first elongated pocket is prevented from passing back through said first slot from said bottom side of said platform to said top side of said platform;

so that when said second anchor member is passed through said second slot from said top side of said platform to said bottom side of said platform, and said second locking rod is inserted into said second elongated pocket, said second elongated pocket is prevented from passing back through said second slot from said bottom side of said platform to said top side of said platform;

said rounded pivot member having a width of about 3.375 inches;

said rim having a front most portion;

said rounded pivot member having a center;

said center of said rounded pivot member disposed between about 5.0 inches and about 5.5 inches from said inside wall of said front most portion of said rim;

said platform having a forward pitch angle of less than 20°; and, said platform having a roll angle of less than 20°.

3. Method for attaching an exercise attachment to a shoe of a user, comprising:

(a) providing a shoe;

(b) providing an exercise attachment for said shoe including;

a platform having a top side, and an opposite bottom side;

a rounded pivot member disposed on said bottom side of said platform;

a shoe strap which is removably connectable to said platform, said shoe strap for retaining said shoe on said platform;

said platform having a first side and an opposite second side;

a first slot disposed in said first side, said first slot having a first width, said first slot extending from said top side to said bottom side;

a second slot disposed in said second side, said second slot having a second width, said second slot extending from said top side to said bottom side;

said shoe strap having a first anchor member which is shaped and dimensioned to pass though said first slot, said first anchor member having a first elongated pocket;

said shoe strap having a second anchor member which is shaped and dimensioned to pass though said second slot, said second anchor member having a second elongated pocket;

a first locking rod which is shaped and dimensioned to be received by said first elongated pocket, and when so received said first elongated pocket having a first pocket width which is greater than said first width of said first slot;

a second locking rod which is shaped and dimensioned to be received by said second elongated pocket, and when so received said second elongated pocket having a second pocket width which is greater than said second width of said second slot;

(c) passing said first anchor member through said first slot from said top side of said platform to said bottom side of said platform;

(d) inserting said first locking rod into said first elongated pocket, thereby preventing said first elongated pocket from passing back through said first slot;

(e) passing said second anchor member through said second slot from said top side of said platform to said bottom side of said platform; and, (f) inserting said second locking rod into said second elongated pocket, thereby preventing said second elongated pocket from passing back through said second slot.

4. The method of claim 3, further including:

using said shoe strap to connect said shoe to said platform.

5. The method of claim 3, further including:

disconnecting said shoe strap from said shoe;

removing said first locking rod from said first elongated pocket;

passing said first anchor member through said first slot from said bottom side of said platform to said top side of said platform;

removing said second locking rod from said second elongated pocket; and, passing said second anchor member through said first second from said bottom side of said platform to said top side of said platform.

* * * * *